US007310065B2

(12) United States Patent
Anguera Pros et al.

(10) Patent No.: US 7,310,065 B2
(45) Date of Patent: Dec. 18, 2007

(54) UNDERSAMPLED MICROSTRIP ARRAY USING MULTILEVEL AND SPACE-FILLING SHAPED ELEMENTS

(75) Inventors: Jaume Anguera Pros, San Cugat del Valles (ES); Carles Puente Baliarda, San Cugat del Valles (ES); Maria-Carmen Borja Borau, San Cugat del Valles (ES)

(73) Assignee: Fractus, S.A., Barcelona (ES)

( * ) Notice: Subject to any disclaimer, the term of this patent is extended or adjusted under 35 U.S.C. 154(b) by 125 days.

(21) Appl. No.: 11/036,511

(22) Filed: Jan. 12, 2005

(65) Prior Publication Data

US 2005/0128148 A1 Jun. 16, 2005

Related U.S. Application Data

(63) Continuation of application No. PCT/EP02/07835, filed on Jul. 15, 2002.

(51) Int. Cl.
*H01Q 1/38* (2006.01)
*H01Q 21/00* (2006.01)
*H01Q 1/48* (2006.01)

(52) U.S. Cl. ..... 343/700 MS; 343/817; 343/846

(58) Field of Classification Search ..... 343/700 MS, 343/817, 853, 846
See application file for complete search history.

(56) References Cited

U.S. PATENT DOCUMENTS 3,818,490 A 6/1974 Leahy
4,912,481 A 3/1990 Mace et al.
5,168,472 A 12/1992 Lockwood
5,210,542 A 5/1993 Pett et al.
5,453,751 A 9/1995 Tsukamoto et al.
5,534,877 A 7/1996 Sorbello et al.
5,537,367 A 7/1996 Lockwood et al.
6,091,365 A 7/2000 Derneryd et al.
6,104,349 A 8/2000 Cohen
6,127,977 A * 10/2000 Cohen ..... 343/700 MS
6,140,975 A 10/2000 Cohen
6,211,824 B1 4/2001 Holden et al.
6,476,766 B1 11/2002 Cohen (Continued)

FOREIGN PATENT DOCUMENTS

EP 0 688 040 12/1995

(Continued)

OTHER PUBLICATIONS

Baliarda, Carles Puente, "Fractal Antennas", Dissertation, Electromagnetics and Photonics Engineering Group, May 1997.

(Continued)

*Primary Examiner*—Shih-Chao Chen
(74) *Attorney, Agent, or Firm*—Winstead PC

(57) ABSTRACT

An undersampled microstrip array using multilevel and space-filling shaped patch elements based on a fractal geometry achieves within the same electrical area, the same directivity than can be obtained using conventional elements as square or circular-shaped patches. However, the number of elements for the fractal-based array is less, reducing the complexity of the feeding network and overall array. Mutual coupling can be reduced avoiding radiation pattern distortions. Higher gain than that obtained using classical patch elements within the same electrical can be achieved due to the less complexity in the feeding network.

14 Claims, 13 Drawing Sheets

U.S. PATENT DOCUMENTS

| | | | | |
|---|---|---|---|---|
| 6,525,691 | B2 * | 2/2003 | Varadan et al. | 343/700 MS |
| 6,642,898 | B2 | 11/2003 | Eason | |
| 6,741,210 | B2 | 5/2004 | Brachat et al. | |
| 6,795,020 | B2 | 9/2004 | Sreenivas et al. | |
| 7,015,868 | B2 | 10/2004 | Puente et al. | |
| 7,019,695 | B2 * | 3/2006 | Cohen | 343/700 MS |
| 2002/0109633 | A1 | 8/2002 | Ow et al. | |
| 2002/0171601 | A1 | 11/2002 | Baliarda | |
| 2002/0190904 | A1 | 12/2002 | Cohen | |
| 2003/0160723 | A1 | 8/2003 | Cohen | |
| 2004/0017317 | A1 | 1/2004 | Schmiade | |

FOREIGN PATENT DOCUMENTS

| | | | |
|---|---|---|---|
| EP | 1 071 161 | | 1/2001 |
| ES | 2164005 | A1 | 2/2002 |
| WO | WO-9706578 | | 2/1997 |
| WO | WO-9735360 | | 9/1997 |
| WO | WO-01/22528 | | 3/2001 |
| WO | WO-01/31747 | | 5/2001 |
| WO | WO-01/54225 | | 7/2001 |
| WO | WO-02063714 | | 8/2002 |
| WO | WO-02084790 | | 10/2002 |
| WO | WO-03034545 | | 4/2003 |
| WO | WO-2004010532 | | 1/2004 |

OTHER PUBLICATIONS

Kim, Y. et al., "The Fractal Random Array", IEEE, Proceedings of the IEEE, vol. 74, No. 9, Sep. 1986, pp. 1278-1280.

Puente-Baliarda, Carles et al., "Fractal Design of Multiband and Low Side-Lobe Arrays", IEEE Transactions on Antennas and Propagation, vol. 44, No. 5, May 1996, pp. 730-739.

Borja, Carmen et al., "On the Behavior of Koch Island Fractal Boundary Microstrip Patch Antenna", 8 pages no date.

Borja, Carmen et al., "Fractal Multiband Patch Antenna", 4 pages no date.

Prasad, R. V. Hara et al., "Microstrip Fractal Patch Antenna for Multiband Communication", Electronics Letters, vol. 36, No. 14, Jul. 6, 2000, pp. 1179-1180.

Borja, C. et al., "Multiband Sierpinski Fractal Patch Antenna", Electromaganetics & Photonics Engineering Group, 4 pages no date.

Anguera, Jaume et al., "Antena Microstrip Miniatura y de Alta Directividad Basada en el Fractal de Sierpinski", Fractus SA, 2 pages no date.

Borja, C et al., "Iterative Network Models to Predict the Performance of Sierkinski Fractal Antennas and Networks", Electromagnetics & Photonics Engineering Group, 4 pages no date.

Herscovici, Naftali, "New Considerations in the Design of Microstrip Antennas", IEEE Transactions on Antennas and Propagation, vol. 46, No. 6, Jun. 1998, pp. 807-812.

John Huang, "A Ka-Band Circularly Piolarized High-Grain Microstrip Array Antenna", IEEE Transactions on Antennas and Propagation, vol. 43, No. 1, Jan. 1995, pp. 113-116.

B. Sapoval et al, "Vibrations of Fractal Drums", the American Society, vol. 67, No. 21, pp. 2974-2977, Nov. 1991.

J. Anguera et al., "Small and High Directivity Bow-tie Patch Antenna Based on the Sierpinski Fractal", Mircowave and Optical Technology Letters, vol. 31, No. 3, pp. 239-241, Nov. 2001.

E. Levine et al., "Study of Microstrip Array Antennas with the Feed Network", IEEE Transactions on Antennas and Propagation, vol. 37, No. 4, pp. 426-434, Apr. 1989.

Borja, C. et al., "High Directivity Fractal Boundary Microstrip Patch Antenna", Electronics Letters, Apr. 27, 2000, vol. 36, No. 9, (pp. 778-779).

Gianvittorio, John P. et al., "Fractal Loop Elements in Phased Array Antennas: Reduced Mutual Coupling and Tighter Packing", Phased Array Systems and Technology, 2000 Proceedings, 2000 IEEE International Conference on Dana Point, CA, USA May 21-25, 2000, Piscataway, NJ, USA, IEEE May 21, 2000 (pp. 315-318).

Montesinos et al, The Sierpinski fractal bowtie patch: a multifracton-mode antenna, IEEE Antennas and propagation society international symposium, Jun. 2002.

Gianvittorio et al, Fractal elements in array antennas: investigating reduced mutual coupling and tighter packing, IEEE Antennas and propagation society international symposiu, Jul. 2000.

J. P. Gianvittorio et al, Fractal antennas - a novel antenna miniturization technique and applications, IEEE Antennas and propagation magazine, Feb. 2002.

J. Chang et al, Triangular fractal antenna, Microwave and optical technology letters, Oct. 2000.

J. Anguera, C. Puente, C. Borja, R. Montero, Bowtie microstrip patch antenna based on the sierpinski fractal, IEEE Antennas and Propagation Society International Symposium, Jul. 2001.

J. Romeu, C. Borja, S. Blanch, High directivity modes in the koch island fractal patch antenna, IEEE Antennas and Propagation Society International Symposium, 2000.

C. Borja, J. Romeu, IEEE Antennas and Propagation Society International Symposium, Fracton vibration modes in the sierpinski, microstrip patch antenna, 2001.

C. Borja, Fractal microstrip patch antennas with fractal perimeter and self-affine properties, Universitat Politecnica de Catalunya, May 2001.

C. Benoit et al. Dynamic and scattering properties of the Sierpinski gasket, Journal of Physics, Mar. 1992.

B. Sapoval et al, Vibrations of strongly irregular or fractal resonatorsl, Physical review, May 1993.

* cited by examiner (prior-art)

(prior-art)

(prior-art)

(prior-art)

UNDERSAMPLED MICROSTRIP ARRAY USING MULTILEVEL AND SPACE-FILLING SHAPED ELEMENTS

This application is a CON of PCT/EP02/07835 filed on Jul. 15, 2002.

OBJECT AND BACKGROUND OF THE INVENTION

The application is a continuation of PCT/EP02/07835 filed on Jul. 15, 2002.

High directivity microstrip arrays are becoming an alternative to parabolic reflector antennas due to its thin profile and less mechanical complexity [J. Huang. "Ka-Band Circularly Polarized High-Gain Microstrip Array Antenna", IEEE Trans. Antennas and Propagation, vol. 43, no. 1, pp. 113–116, January 1995.]. However, one important problem is the complexity of the feeding network to feed the large number of elements [E. Levine, G. Malamud, S. Shtrikman, D. Treves. "Study of Microstrip Array Antennas with the Feed Network", IEEE Trans. Antennas and Propagation, vol. 37, no. 4, pp. 426–434, April 1989.]. Thus, a large space is needed for the feeding network. Furthermore, in a phased-array, phase-shifters, amplifiers and other MMICs have to be integrated together with the feeding network and this is a significant integration problem. In this sense, the present invention proposes a novel scheme for microstrip arrays using multilevel or space-filling shaped antenna elements ["Multilevel Antennae", Invention Patent WO0122528.], ["Space-Filling Miniature Antennas", WO0154225]. A multilevel structure for an antenna device, as it is known in prior art, consists of a conducting structure including a set of polygons, all of said polygons featuring the same number of sides, wherein said polygons are electromagnetically coupled either by means of a capacitive coupling or ohmic contact, wherein the contact region between directly connected polygons is narrower than 50% of the perimeter of said polygons in at least 75% of said polygons defining said conducting multilevel structure. In this definition of multilevel structures, circles, and ellipses are included as well, since they can be understood as polygons with a very large (ideally infinite.) number of sides. An antenna is said to be a multilevel antenna, when at least a portion of the antenna is shaped as a multilevel structure. A space-filling curve for a space-filling antenna, as it is known in prior art, is composed by at least ten segments which are connected in such a way that each segment forms an angle with their neighbours, i.e., no pair of adjacent segments define a larger straight segment, and wherein the curve can be optionally periodic along a fixed straight direction of space if and only if the period is defined by a non-periodic curve composed by at least ten connected segments and no pair of said adjacent and connected segments define a straight longer segment. Also, whatever the design of such SFC is, it can never intersect with itself at any point except the initial and final point (that is, the whole curve can be arranged as a closed curve or loop, but none of the parts of the curve can become a closed loop). The present invention consist on combining several of these elements in a novel configuration for an antenna array, such that the number of radiating elements is reduced with respect to prior art, while the overall directivity of the antenna is kept. The main advantage is that a less number of elements is needed compared to the state of the art approach when the array is designed according to the present invention. FIG. 6 shows a classical approach of a bidimensional array using circular patches where the separation between elements is less than 0.9λ at the operating frequency, being λ the wavelength of the operating frequency. FIG. 7 shows a novel scheme of a bidimensional array using a multilevel shaped patch where separation between elements is larger than 0.9λ at the operating frequency. FIG. 8 shows another novel scheme of a bidimensional array using a space-filling shaped patch where the element separation is larger than 0.9λ in one direction but less than 0.9λ in the perpendicular direction. The novel schemes presented at FIG. 7 and FIG. 8 have less number of elements compared to the classical prior-art scheme of FIG. 6. This arrangement for the arrav of using less elements is novel and constitutes the heart of the present invention. Such microstrip arrays can employ less elements thanks to the multilevel or space-filling shaped elements. An advantage of using less elements, for example, is that the feeding network complexity decreases and consequently more space is available to integrate other microwave components. Also, it reduces the antenna volume and weight, which can be an advantage in cost, for instance, in satellite antennas.

The multilevel and space-filling shaped patch elements used as a radiating elements of the array in the present invention feature high-directivity performance. Such behaviour can be found in the prior art [C. Borja, G. Font, S. Blanch, J. Romeu, "High directivity fractal boundary microstrip patch antenna", IEE Electronic Letters, vol. 26, No. 9, pp. 778–779, 2000], [J. Anguera, C. Puente, C. Borja, R. Montero, J. Soler, "Small and High Directivity Bowtie Patch Antenna based on the Sierpinski Fractal", Microwave and Optical Technology Letters, vol. 31, No. 3, pp. 239–241, November 2001]. The multilevel and space-filling shaped patch elements support resonating modes called fractons and fractinos according to the nomenclature heritaged from the acoustical field [B. Sapoval, Th. Gobron, A. Margolina "Vibrations of Fractal Drums", The American Physical Society, vol. 67, No. 21, pp. 2974–2977, November 1991.]. Depending on the antenna geometry, the antenna support fracton or fractino modes: roughly speaking, such modes are resonating modes with a resonating frequency larger than the fundamental mode (the lowest resonant frequency). When the antenna is operating in a fracton or fractino mode, the directivity is much larger than the antenna when operating in the fundamental mode and even preserving a broadside radiation pattern.

SUMMARY OF THE INVENTION

The key point of the present invention in to use multilevel or space-filling shaped patch elements in an array environment; such patch elements are operating in a fracton or fractino modes. Such modes, as mentioned before, are resonating modes with a frequency larger than the fundamental one characterized by presenting a broadside radiation pattern with a directivity larger than that obtained for the radiation pattern of the fundamental mode.

When said elements are used in an array environment, and thanks to their higher directivity, a less number of elements is necessary to achieve the same directivity if classical Euclidean patch elements were used (square, circular, triangular-shaped, etc). In other words, in a given area, one can obtain the same directivity using classical patches or multilevel/space-filling shaped patch elements, however in the later case, the number of elements can be reduced.

For example, in some embodiments one can reduce at least by 3 the number of classical elements by employing multilevel or space-filling shaped patch elements. A larger element reduction can be achieved if one operates in a higher fracton or fractino mode where directivity is much larger than the previous modes ones, for example, one can achieve a reduction of 10 operating in a higher fracton or fractino mode. This less number of elements represents an advantage in arrays environments because the feeding network complexity decreases: there is more available space to place other microwave components such phase-shifters, amplifiers, filters, matching networks, diplexers, etc. This property represents an advantage, for example, in satellite antennas where the antenna volume and weight can be decreased because there is no need to add a new extra module for the above mentioned microwave components (amplifiers, etc).

Thanks to the high-directivity of such fracton/fractino modes supported by the multilevel and space-filling shaped elements, the element spacing between elements can be larger than the typical 0.9λ w at the operating frequency as the scheme shown in FIG. 6 where 14×13 classical prior-art circular patches are used. In this sense, FIG. 7 depicts a novel scheme formed by only 8×8 multilevel shaped elements where separation between elements is larger than 0.9λ in the horizontal and vertical directions. FIG. 8 shows the same previous concept but now 16×8 space-filling shaped elements are employed.

In this later case, only the horizontal direction presents a element spacing larger than 0.9λ while in the vertical direction the element spacing in less than 0.9λ. The advantage of both schemes shown in FIGS. 7 and 8 is that they use less number of elements than classical prior-art approaches with classical patches, like that depicted in FIG. 6, achieving the same directivity within the same area. The second scheme represented in FIG. 8, although uses more elements than the scheme of FIG. 7, it improves the beam-steering capabilities.

Another advantage of the present invention is that, in some embodiments, the mutual coupling between elements can be reduced since the distance between elements is increased. Therefore, radiation patterns distortions or beam-steering problems can be reduced with respect the classical approach using classical patch elements operating in their fundamental mode.

Finally, another significant advantage is that the number of T-junctions and bends is reduced. For example, FIG. 9 shows a corporate feed network for a 16 element linear array which it is a typical arrangement described in the prior art. On the other hand, FIG. 10 shows another corporate feed network for a 8 multilevel-shaped element linear array. Both arrays achieve the same directivity, however, the feeding network used for FIG. 10 present less T-junctions and bends. This reduction represents in general, an improvement in the antenna efficiency and polarization purity and it is a novel advantage obtained through to the proposed invention.

DETAILED DESCRIPTION OF THE PREFERRED EMBODIMENTS

Figure 1:
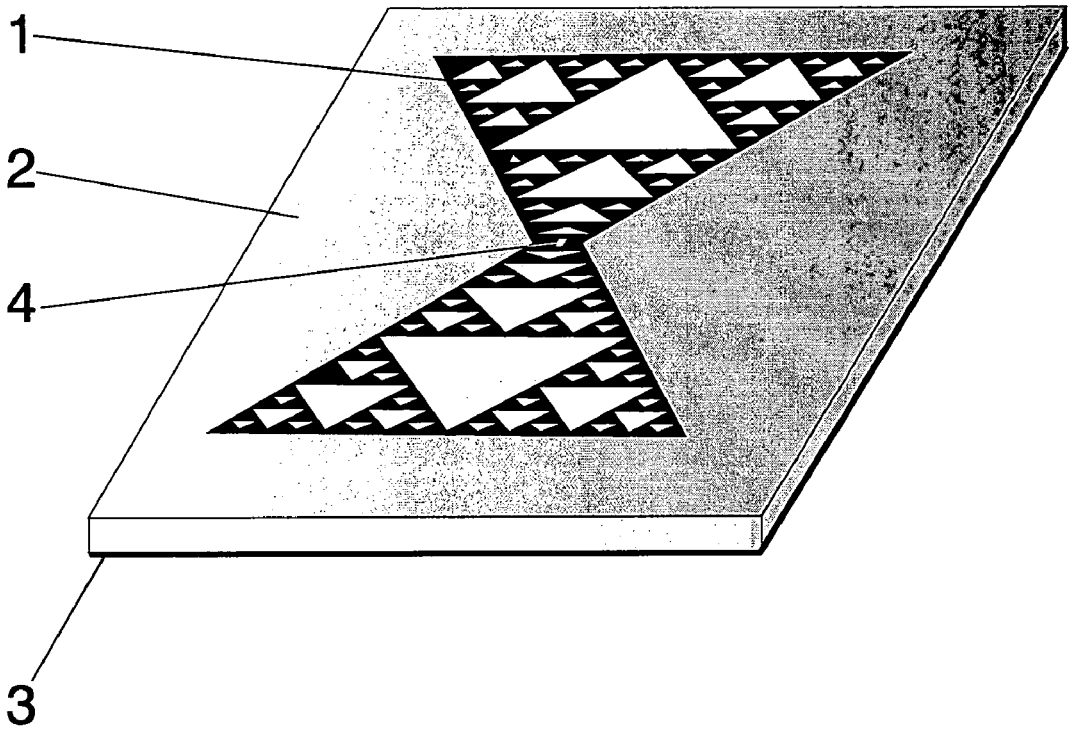
FIG. 1 Shows a particular example of a microstrip patch (1) showing a multilevel geometry inspired on the Sierpinski fractal geometry. The antenna is etched on the top part of a thin substrate (2); the groundplane (3) is on the bottom part. In this particular case, the antenna is coaxially fed (4) which it is a well known feeding mechanism described in prior art.

FIG. 1 shows an example of a the basic radiating multilevel element (1) that achieves a broadside radiation pattern with a higher directivity than that of a classical Euclidean patch operating at the same frequency (squares, circular-shaped, etc). The patch can be, for instance, printed over a dielectric substrate (2) or can be, for instance, conformed through a laser process. Any of the well-known printed circuit fabrication techniques can be applied to pattern the multilevel or space-filling element over the dielectric substrate. Said dielectric substrate can be, for instance, a glass-fibre board, a teflon based substrate (such as Cuclad®) or other standard radiofrequency and microwave substrates (as for instance Rogers 4003® or Kapton®). The behaviour of the antenna represented in FIG. 1 has been already published in [J. Anguera, C. Puente, C. Borja, R. Montero, J. Soler, "Small and High Directivity Bowtie Patch Antenna based on the Sierpinski Fractal", Microwave and Optical Technology Letters, vol. 31, No. 3, pp. 239–241, November 2001].

Figure 2:
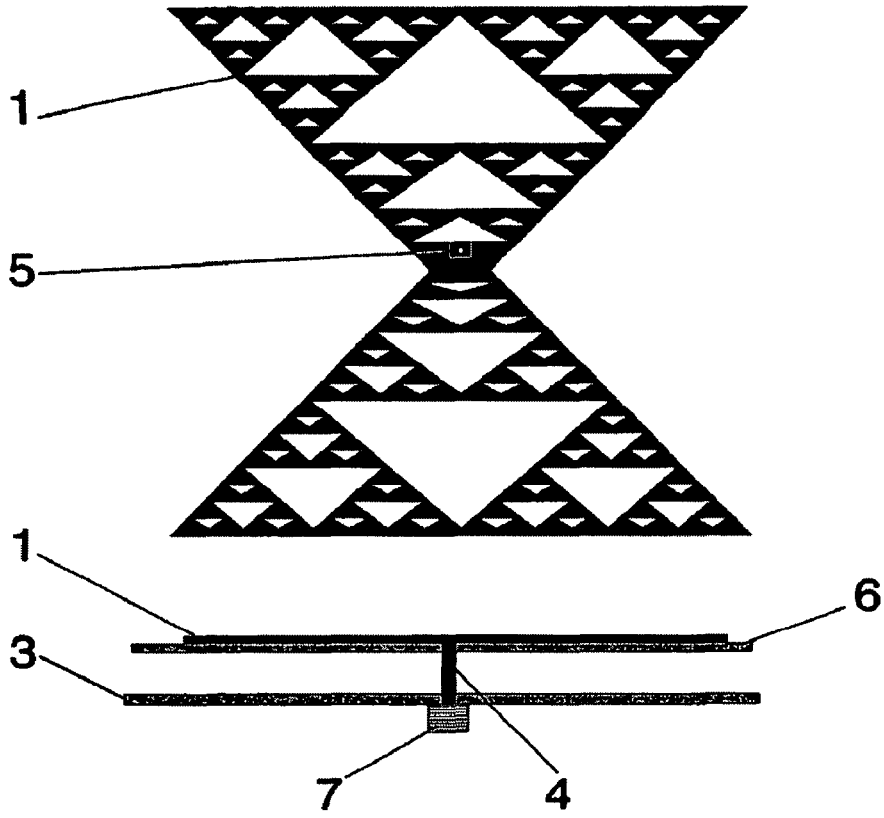
FIG. 2 Shows the same particular geometry of FIG. 1. In this case, the antenna is etched on a thin substrate (6) suspended in air above a groundplane (3). The antenna is coaxially fed (4) using a capacitively coupling (5) using a gap between the feeding and the patch. The gap mechanism applied to the multilevel shaped patch is innovative and constitutes an essential part of the present invention.

The feeding scheme can be taken to be any of the well-known schemes used in prior art patch antennas, for instance: a coaxial cable (4,7) with the outer conductor (7) connected to the ground-plane and the inner conductor (4) connected to the active patch at the desired input resistance point (of course the typical modifications including a capacitive gap (5) on the patch around the coaxial connecting (FIG. 2) point or a capacitive plate connected to the inner conductor of the coaxial placed at a distance parallel to the patch, and so on can be used as well; a microstrip transmission line sharing the same ground-plane as the active patch antenna with the strip capacitively coupled to the active patch and located at a distance below the said active patch, or in another embodiment with the strip placed below the ground-plane and coupled to the active patch through a slot, and even a microstrip transmission line with the strip co-planar to the active patch can be, for instance, also used. All these mechanisms are well known from prior art and do not constitute an essential part of the present invention.

Figure 3:
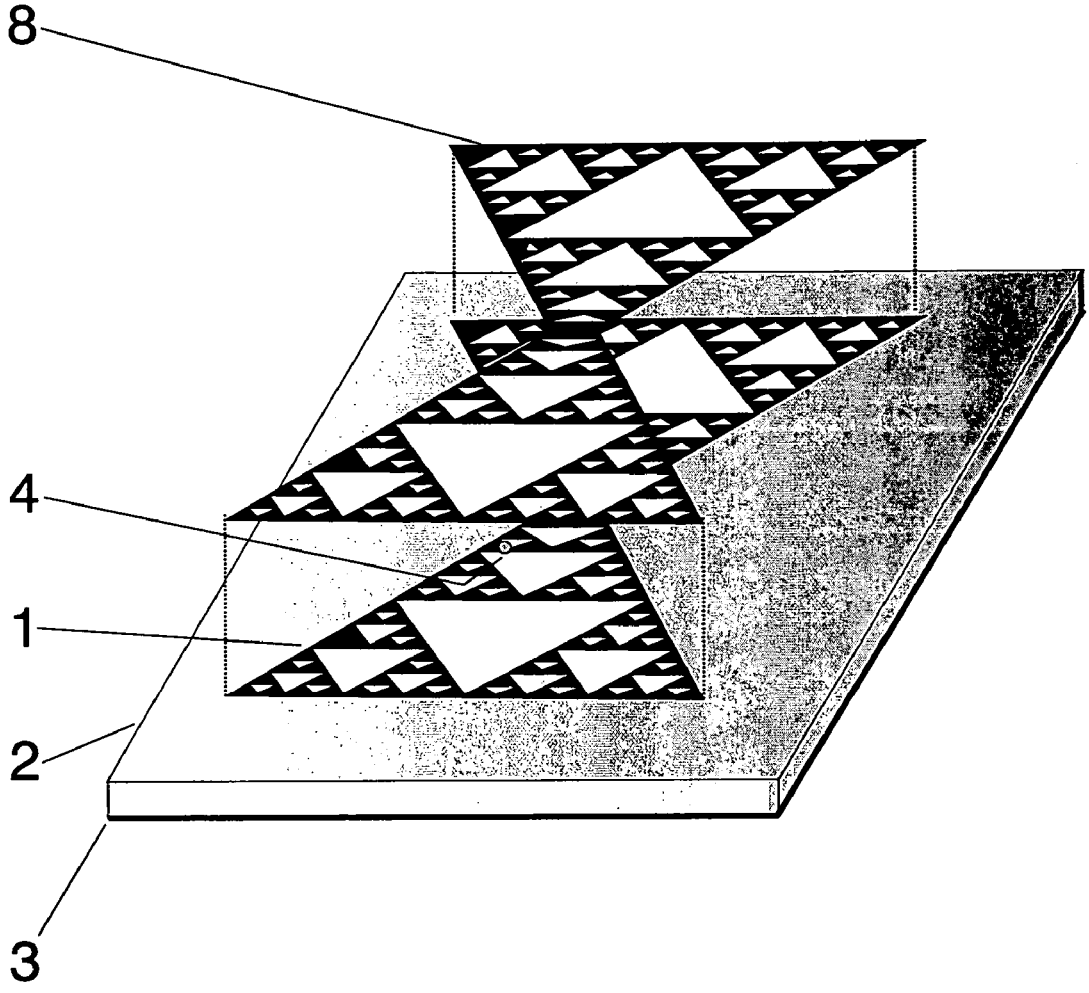
FIG. 3 Shows a stacked structure formed by one active patch (1) and a parasitic patch (8). Both structures are multilevel patch elements inspired on the Sierpinski geometry. The active patch is etched on a thin substrate (2) and is coaxially fed (4). The stacked structure of FIG. 3 using multilevel shaped elements is innovative and constitutes an essential part of the present invention.

Another preferred embodiment based on a novel configuration using a stacked structure (FIG. 3) can be used as well where one parasitic patch (8) is placed over the active patch (1). In FIG. 3 an example of a stacked structure using a multilevel shaped element is used for the active (1) and parasitic (8) patches. However, other multilevel or space-filling shaped geometries can be used. The structure described in FIG. 3 is original and constitutes an essential part of the present invention.

Figure 4:
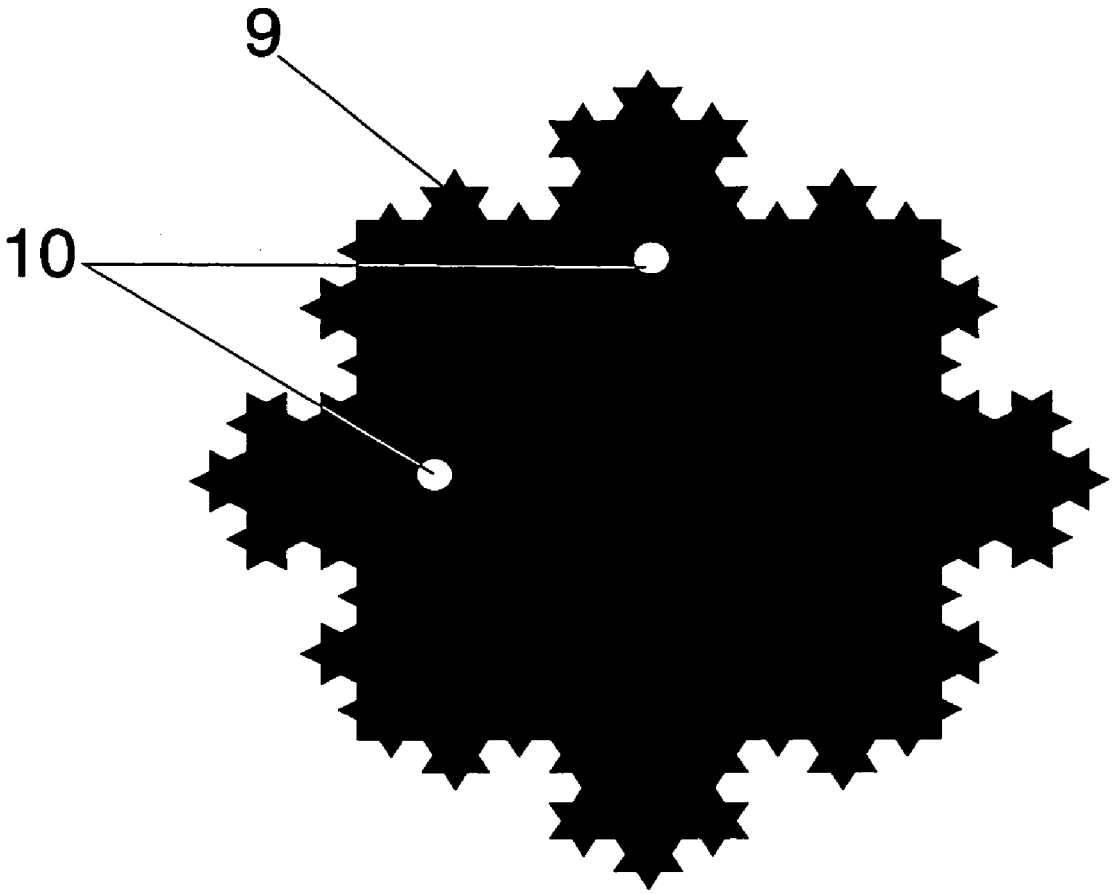
FIG. 4 Depicts the layout (9) on a space-filling patch based on the fractal Koch curve. In this case, the patch is fed by two coaxial probes (10). Two feeding probes are used to achieve a cross or circular polarized antenna. The mechanisms to generate cross and circular polarized microstrip antennas is well know from prior art.

For dual polarized or circular polarized microstrip arrays, a novel patch geometry using a space-filling shaped patch can be used. FIG. 4 shows two feeding probes (10) that are properly placed to obtain a dual-polarized or circular polarized behaviour.

Figure 5:
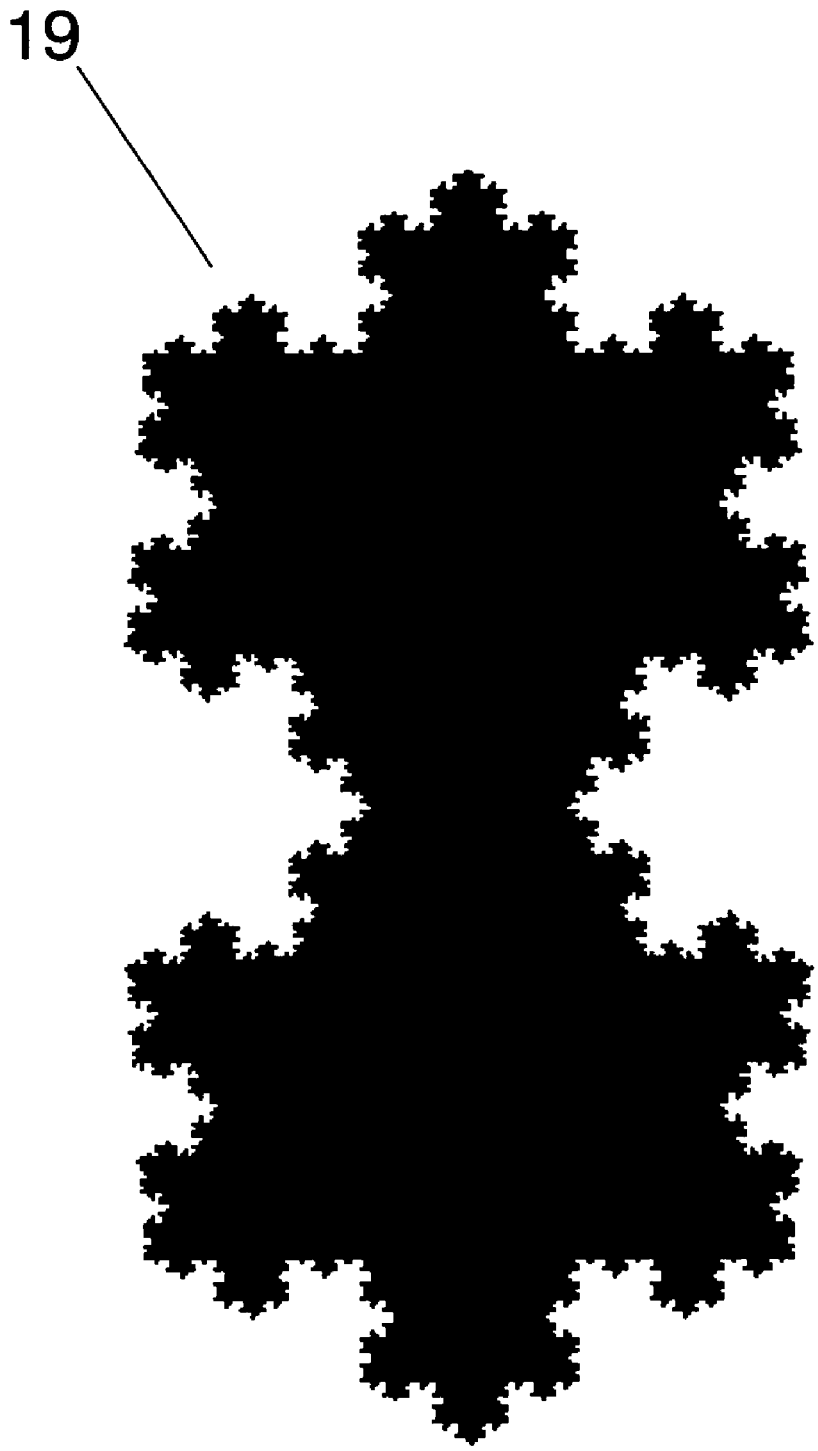
FIG. 5 Depicts another example of a space-filling geometry based on the bowtie-shaped Koch curve (19). Such geometry thanks to its profile support fraction modes. The utilization of this patch is a microstrip array is original and thus constitutes an essential part of the present invention.

FIG. 5 shows a novel space-filling shaped geometry inspired in the fractal Koch curve. Such geometry presents a thin profile that is useful for some array applications such for example linear arrays where the width space has to be kept under a certain limitation.

Figure 6:
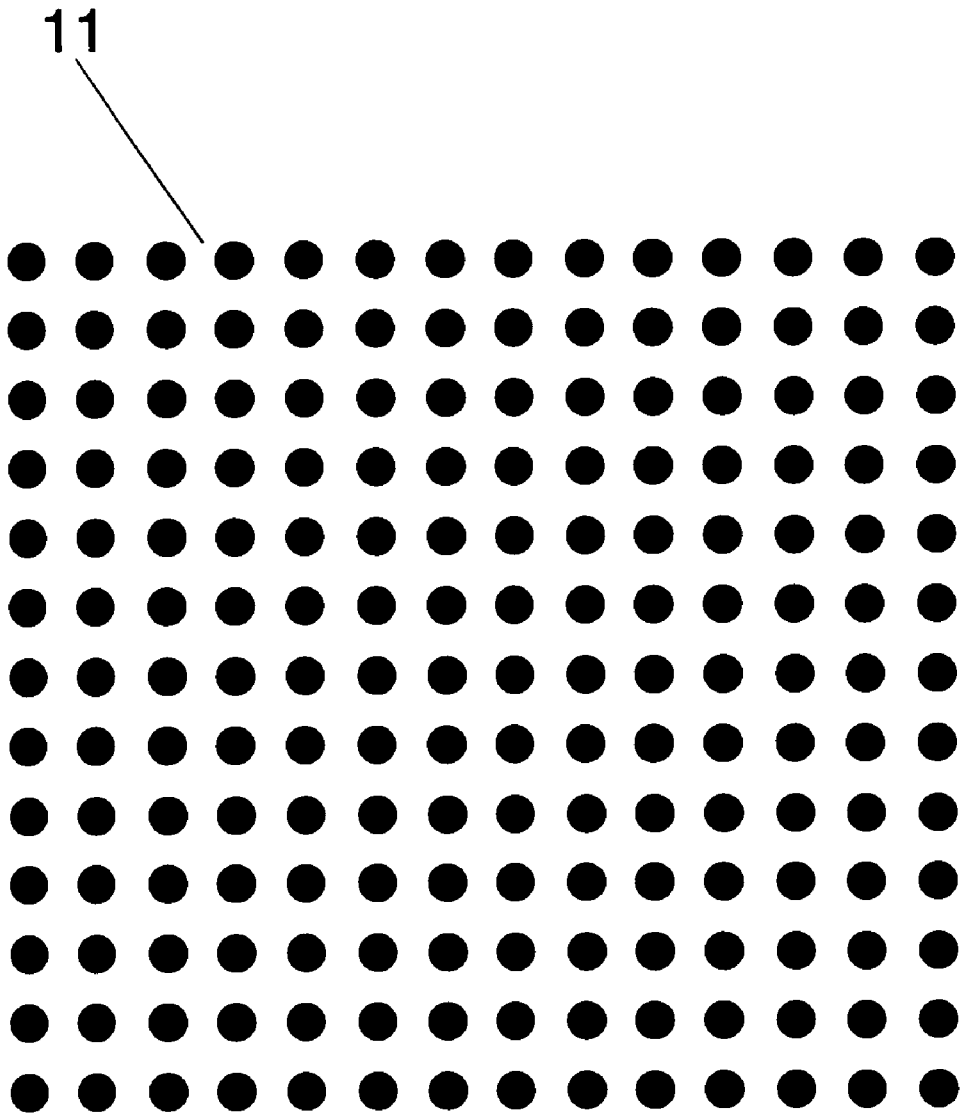
FIG. 6 Represents a classical square gridding (11) using circular patches which it is a typical scheme described in the prior art.
Figure 7:
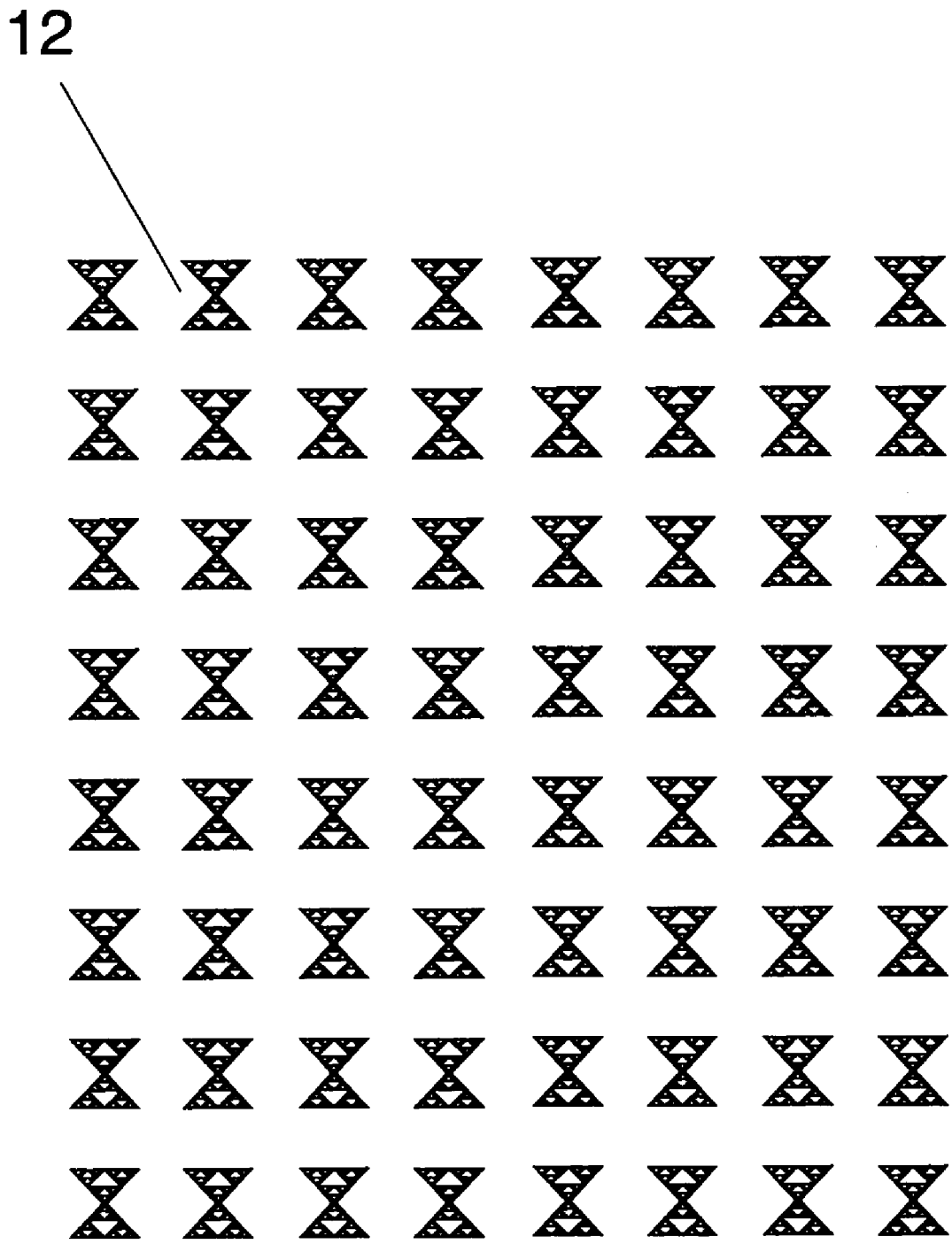
FIG. 7 Represents a novel square gridding using multilevel shaped patches formed by 8×8 elements (12).

FIG. 6 Shows a well-known from prior art bidimensional array formed by 14 by 13 circular patches while FIG. 7 shows a preferred embodiment using a novel scheme of bidimensional array formed by only 8×8 multilevel-shaped patches. In both cases the patches can be etched on any of the well-known microwave substrates. The scheme represented in FIG. 7 is novel and represents one of the main part of the present invention.

Any of the well known prior art feeding architectures for microstrip arrays can be use to fed the patch elements (corporate, series, H-shaped). Moreover, the feeding network can be etched, for instance, in the same layer where the patches are etched or can be, for example, etched on a separate layer to avoid interferences from the feeding network.

Figure 8:
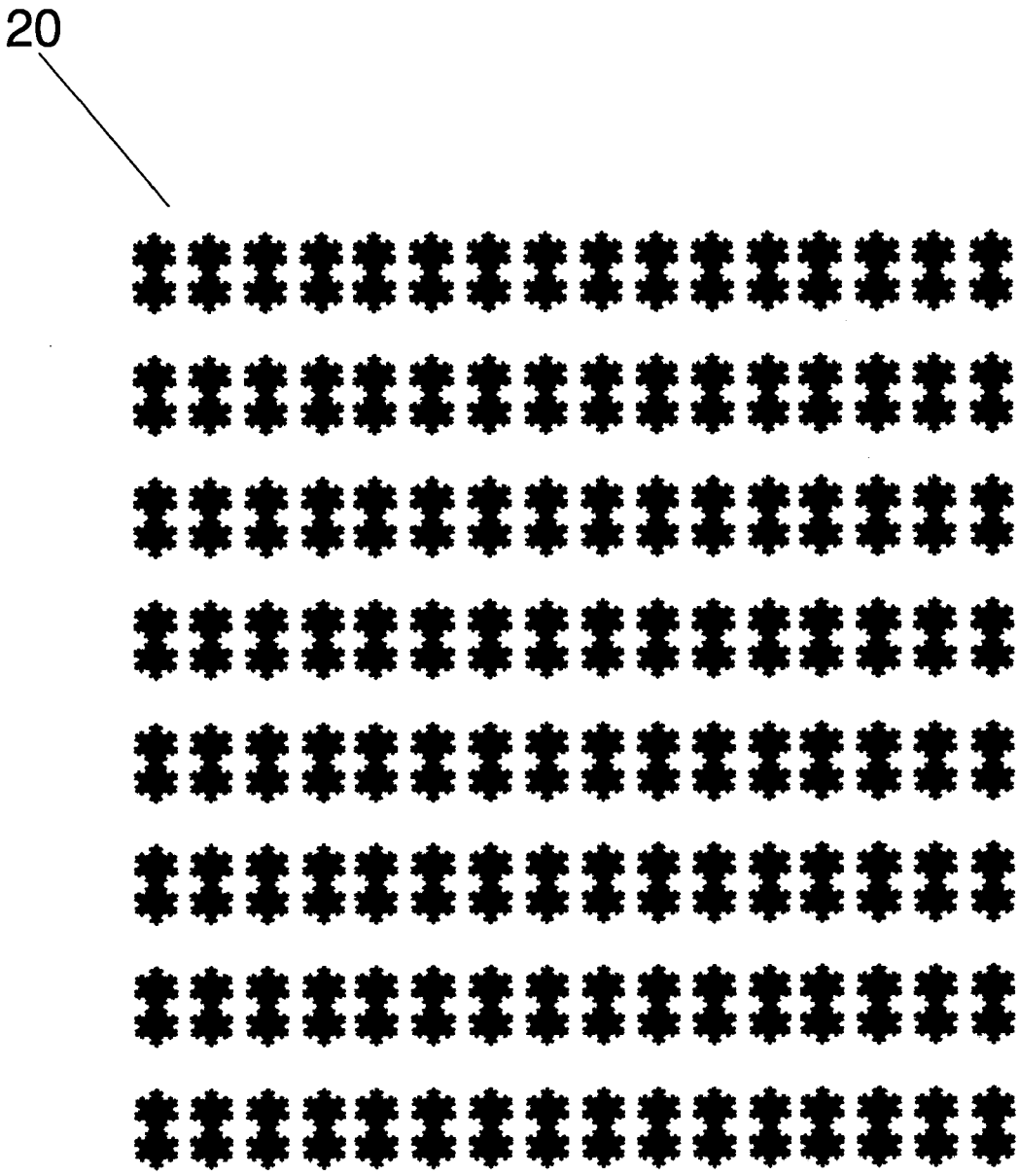
FIG. 8 Shows a novel square gridding using space-filling shaped patch elements formed by 16×8 elements (20).

Another preferred embodiment is presented in FIG. 8 where it shows a bidimensional array formed by 8×16 space-filling shaped elements. This novel scheme is suitable to increase the beam-steering capabilities. In order to reduce mutual coupling between elements, photonic band gap (PBG) substrates can be, for instance, employed. The utilization of special dielectric material such as PBGs, magnetic substrates and other special ones it is well know for those skilled in the art and do not constitute and essential part of the present invention.

Figure 9:
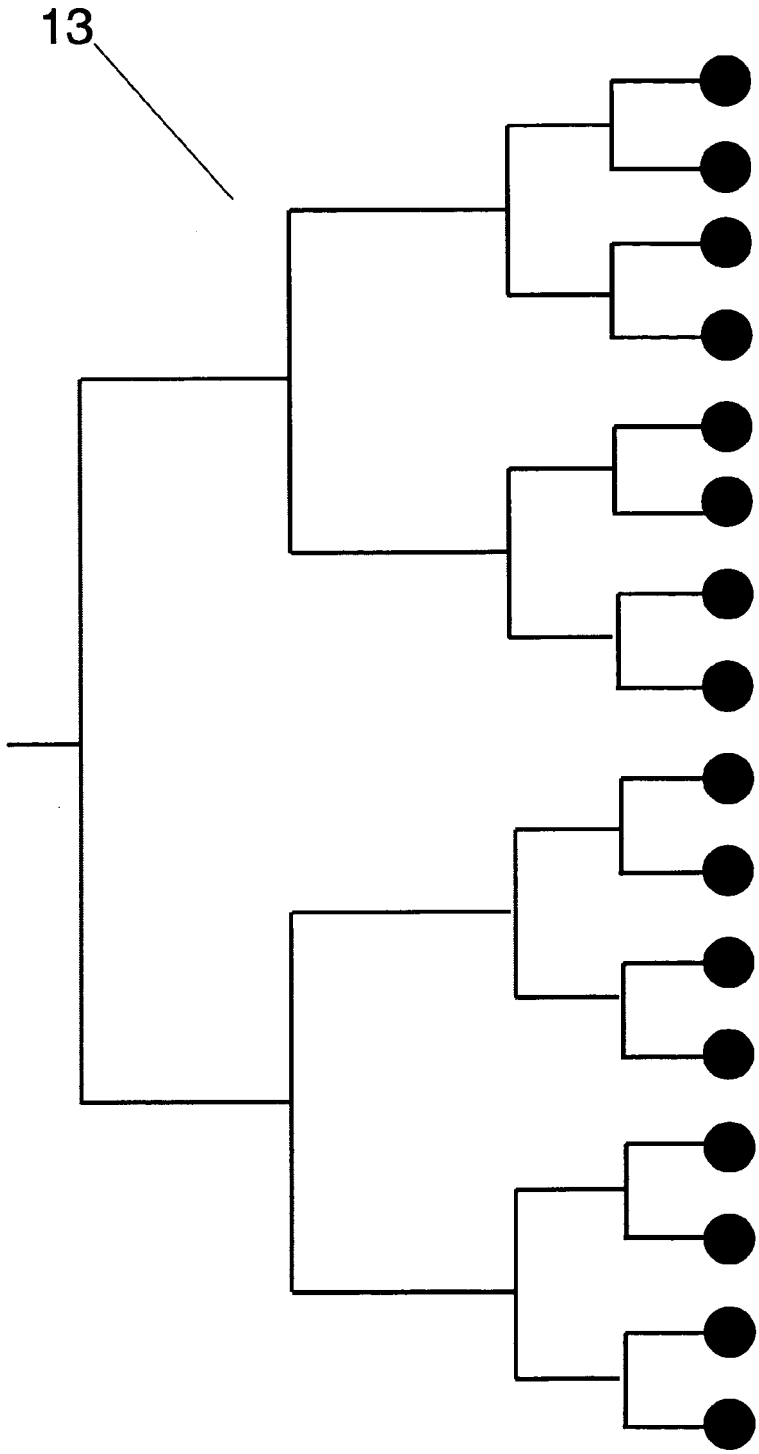
FIG. 9 Shows a schematic (13) of a feeding corporate network for a linear 16 element array using circular patches which it is a typical arrangement well know from prior art.
Figure 10:
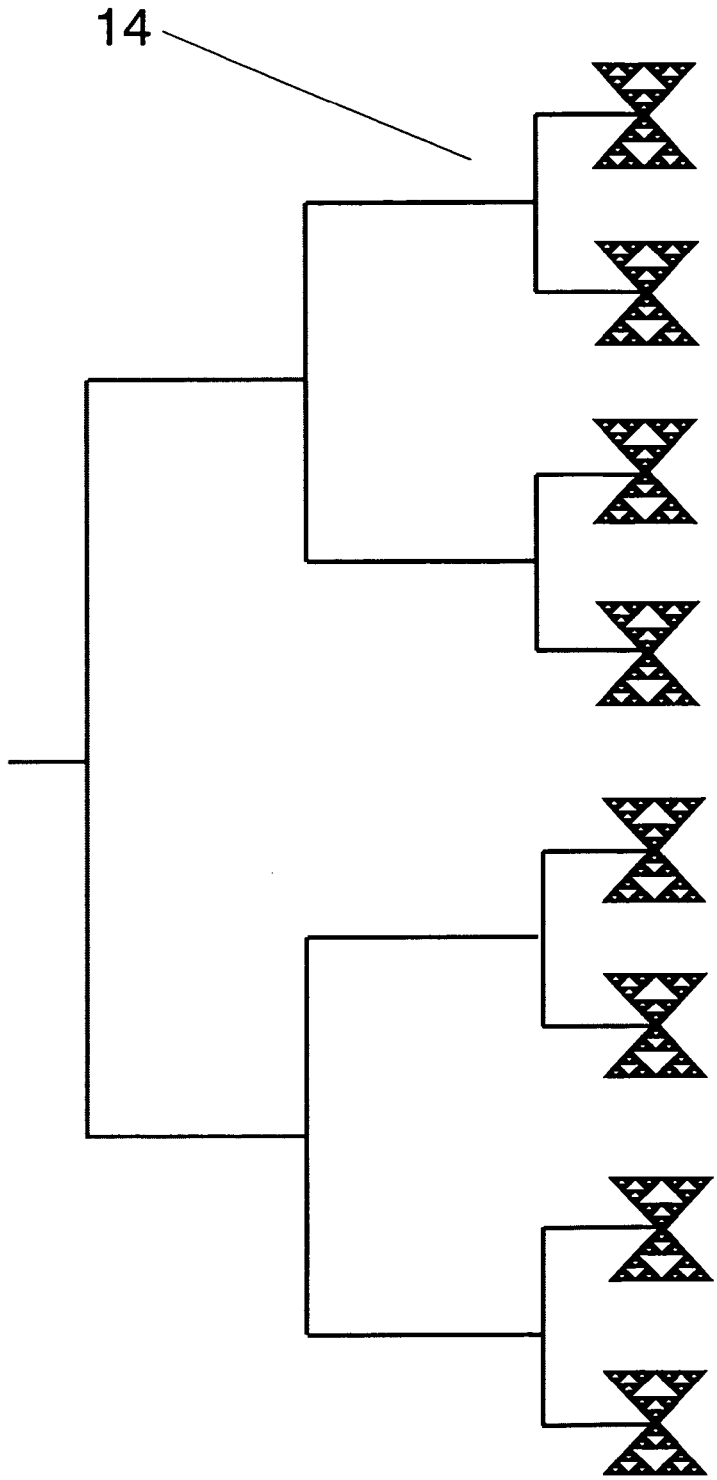
FIG. 10 Shows a schematic (14) of a feeding corporate network for a linear array of 8 multilevel shaped patch elements which it is a novel configuration.
Figure 11:
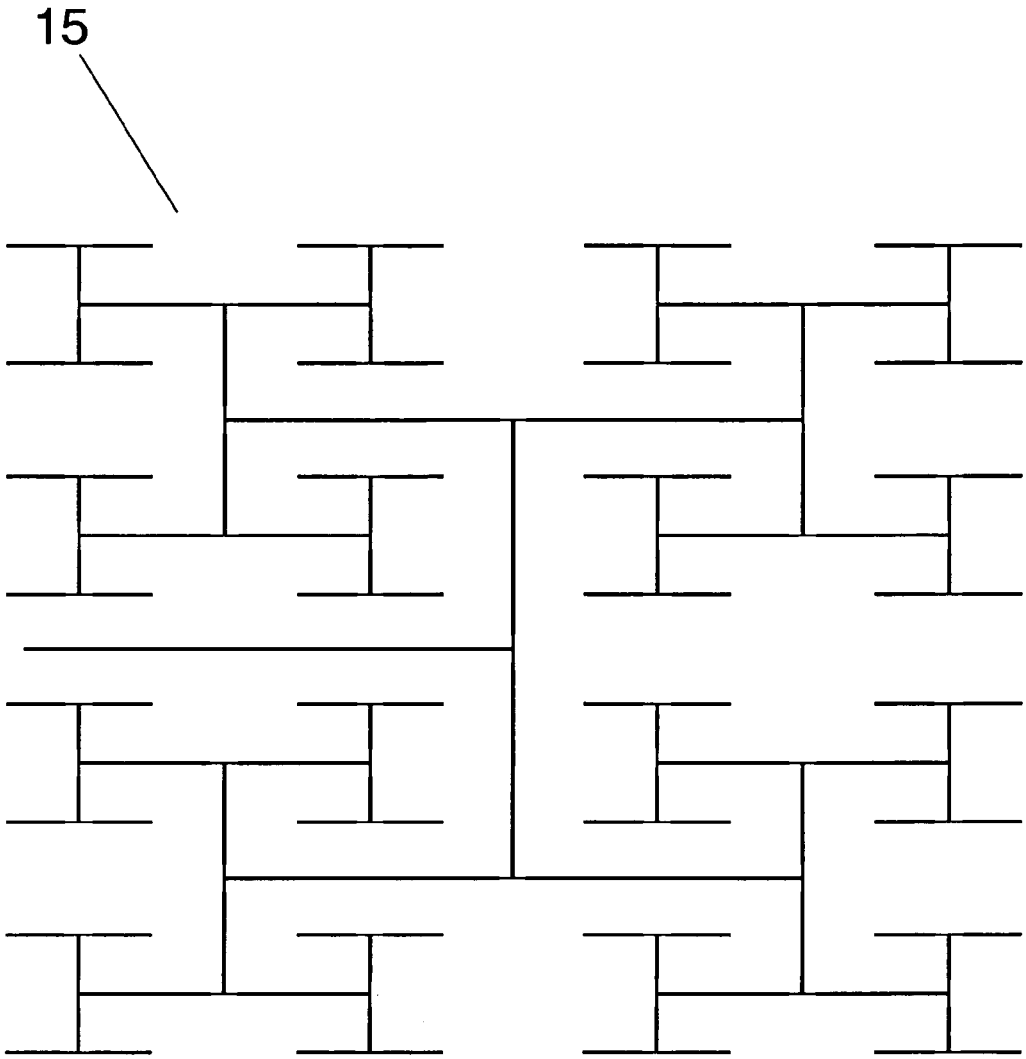
FIG. 11 Shows an example of a H-shaped (15) array feeding architecture. The feeding network can be physically built using the well-know microstrip, stripline and other technologies such for example photonic band gap structures (PBG). Such network feeds a bidimensional array of 8 by 8 patch elements like that of FIG. 7 (12).

FIG. 9 shows a corporate fed network for a prior art 16 element linear array formed by circular patches and FIG. 10 another preferred embodiment using a corporate feeding network for the 8 element linear array formed by multilevel elements according to the present invention. It can be observed that although the directivity and pattern of both are the same, the newly disclosed array requires a simpler structure. FIG. 11 shows an H-shaped feeding network to feed a 8 by 8 array of FIG. 7. All these mechanisms to feed the elements are well known from prior art and do not constitute an essential part of the present invention.

Figure 12:
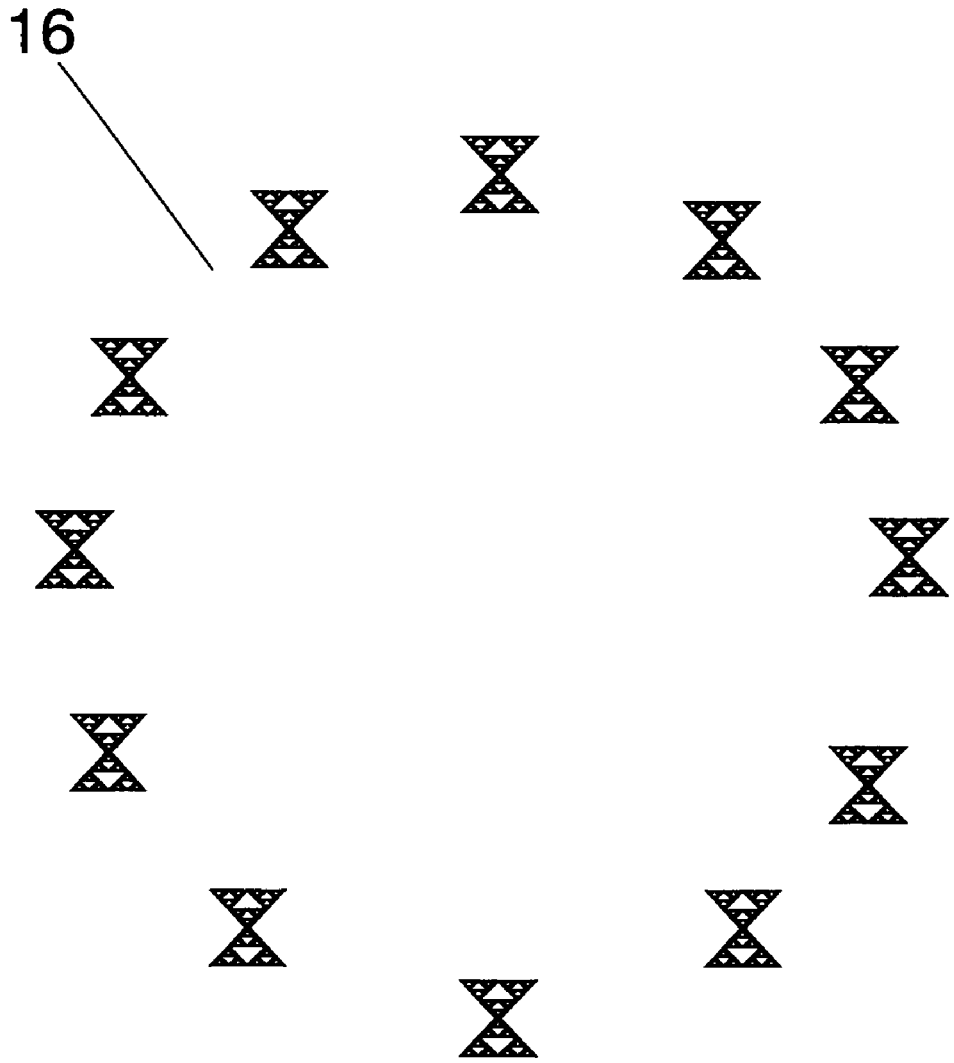
FIG. 12 Shows a novel circular gridding (16) using multilevel patch elements.
Figure 13:
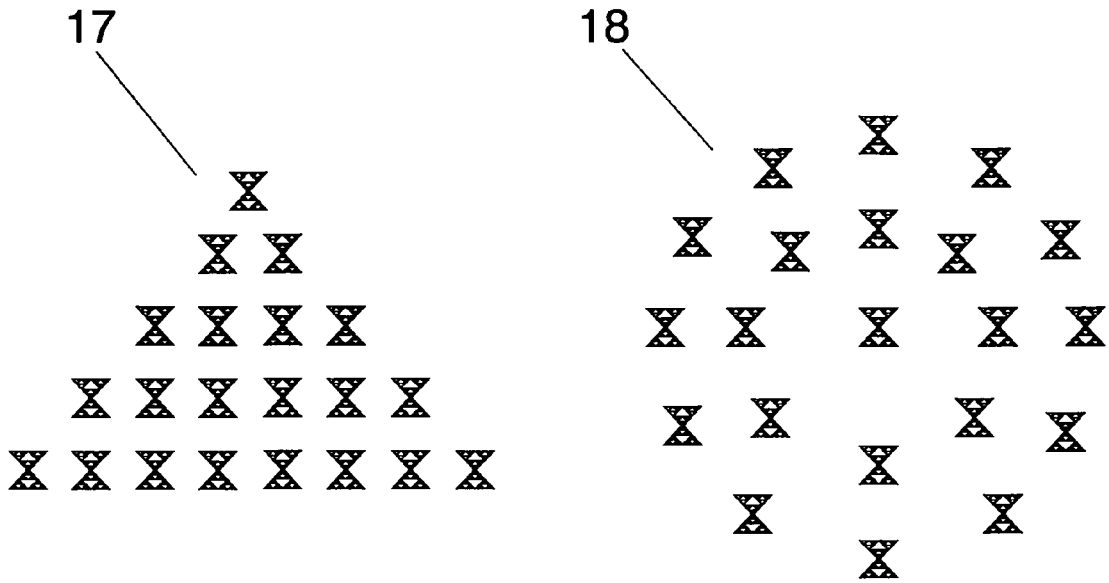
FIG. 13 Shows novel triangular (17) and circular (18) bidimensional griddings employing multilevel patches.

Another preferred embodiment is illustrated in FIG. 12 where it shows a circular-shaped linear array which can be formed by multilevel shaped or space-filling shaped elements or formed by a combination of both. FIG. 13 shows another preferred embodiment formed by two different array disposition where (17) shows a triangular-shaped and (18) shows a square-shaped arrangements. Said arrangement can be, for instance, formed by multilevel or space-filling shaped element or even the combination of both geometries.

The well know amplitude tapering (Taylor, Chebychev, etc) and phase techniques (genetic algorithms, simulated annealing) as well as non-equidistant spacing to synthesize a specific radiation pattern (null filling, beam steering, etc) can be employed and combined within the scope of the present invention, since they are techniques that are well known from prior-art.

The invention claimed is:

1. An antenna array comprising:

patch antenna elements having one of the following shapes: multilevel, space-fillings, or multilevel and space-filling;

the patch antenna elements being adapted to operate at a superior frequency mode, the superior frequency mode being at a frequency of a fundamental mode of the patch antenna elements;

the patch antenna elements featuring a higher directivity when operating at the superior frequency mode than the directivity obtained when the patch antenna elements operate at the fundamental mode;

the patch antenna elements being larger than half of a wavelength, the wavelength being an operating wavelength of the antenna as measured in a dielectric located between at least one patch antenna element and its compounding groundplane; and the patch antenna elements being spaced in at least one direction at a distance larger than $\lambda$ from closest neighbors, $\lambda$ being a free-space operating wavelength of the antenna array.

2. The antenna array of claim 1, wherein the patch antenna elements are disposed along a line forming a linear array arrangement.

3. The antenna array of claim 1, wherein the patch antenna elements are arranged over a rectangular grid.

4. The antenna array of claim 1, wherein the patch antenna elements are arranged over a circular grid.

5. The antenna array of claim 1, wherein spacing between the patch antenna elements is non-uniform.

6. The antenna array of claim 1, wherein said antenna array operates at several frequencies where the minimum separation between the patch antenna elements is larger than $\lambda$ at the lowest operating frequency, $\lambda$ being the wavelength defined at said lowest free-space operating frequency.

7. The antenna array claim 1, wherein the number of patch multilevel or space-filling elements is smaller compared to patch arrays using classical Euclidean patches yet featuring a similar directivity.

8. The antenna array of claim 1, wherein the patch antenna elements are a combination of at least two different multilevel or space-filling shaped patch elements.

9. The antenna array of claim 1, wherein at least one element is a stacked structure formed by one active patch and at least one parasitic patch using multilevel or space-filling shaped geometries.

10. The antenna array of claim 1, wherein the patch antenna elements spacing is larger than λ in one direction but less than λ in the perpendicular direction, wherein said antenna array is formed by multilevel or space-filling shaped patches.

11. The antenna array of claim 1 disposed on a device configured to operate in a communications network.

12. The antenna array of claim 11, wherein the device is a satellite.

13. The antenna array of claim 1, wherein the dielectric is selected from the group consisting of: glass-fibre board, Teflon based substrates, other standard radio-frequency and microwave substrates, and air.

14. An antenna array comprising:

patch antenna elements having one of the following shapes: multilevel, space-filling, or multilevel and space-filling;

the patch antenna elements being larger than half of a wavelength, the wavelength being an operating wavelength of the antenna as measured in a dielectric located between at least one patch antenna element and its compounding groundplane;

the patch antenna elements being spaced at a distance larger than λ from closest neighbors, λ being a free-space operating wavelength of the antenna array; and wherein the patch antenna elements spacing is larger than λ in one direction but less than λ in the perpendicular direction, wherein the antenna array is formed by multilevel or space-filling shaped patches.

* * * * *